US008420587B2

(12) United States Patent
Cermenati et al.

(10) Patent No.: US 8,420,587 B2
(45) Date of Patent: Apr. 16, 2013

(54) LIQUID ACIDIC HARD SURFACE CLEANING COMPOSITION

(75) Inventors: Laura Cermenati, Brussels (BE); William Mario Laurent Verstraeten, Herent (BE); Christopher Andrew Morrison, Genval (BE)

(73) Assignee: The Procter & Gamble Company, Cincinnati, OH (US)

( * ) Notice: Subject to any disclaimer, the term of this patent is extended or adjusted under 35 U.S.C. 154(b) by 48 days.

(21) Appl. No.: 12/201,038

(22) Filed: Aug. 29, 2008

(65) Prior Publication Data

US 2009/0062175 A1 Mar. 5, 2009

(30) Foreign Application Priority Data

Aug. 31, 2007 (EP) ..... 07115412
Dec. 4, 2007 (EP) ..... 07122266

(51) Int. Cl.
*C11D 7/00* (2006.01)

(52) U.S. Cl.
USPC ..... 510/238; 510/199; 510/218; 510/426; 510/475; 510/500

(58) Field of Classification Search ..... 510/238, 510/199, 218, 426, 475, 500
See application file for complete search history.

(56) References Cited

U.S. PATENT DOCUMENTS

| | | | | |
|---|---|---|---|---|
| 4,167,488 | A | 9/1979 | Murtaugh | |
| 4,374,745 | A | 2/1983 | Sibley et al. | |
| 4,501,680 | A * | 2/1985 | Aszman et al. | 510/238 |
| 4,960,533 | A | 10/1990 | Wisniewski et al. | |
| 5,362,422 | A * | 11/1994 | Masters | 510/424 |
| 5,439,609 | A | 8/1995 | Pasek | |
| 5,699,189 | A | 12/1997 | Murphy | |
| 5,741,760 | A | 4/1998 | Mondin et al. | |
| 6,090,765 | A | 7/2000 | Black et al. | |
| 6,191,090 | B1 | 2/2001 | Mondin et al. | |
| 6,239,166 | B1 | 5/2001 | Black | |
| 6,425,959 | B1 * | 7/2002 | Man | 134/39 |
| 6,506,261 | B1 | 1/2003 | Man | |
| 6,537,957 | B1 * | 3/2003 | Cardola et al. | 510/238 |
| 6,998,379 | B1 * | 2/2006 | Costagliola | 510/372 |
| 2002/0115581 | A1 | 8/2002 | DuVal et al. | |
| 2004/0097389 | A1 | 5/2004 | Yeo et al. | |
| 2005/0250668 | A1 | 11/2005 | Serobian et al. | |
| 2006/0281663 | A1 | 12/2006 | Asmus | |
| 2009/0075858 | A1 | 3/2009 | Tomarchio et al. | |

FOREIGN PATENT DOCUMENTS

| | | | |
|---|---|---|---|
| EP | 1 245 666 | A1 | 10/2002 |
| EP | 1 245 667 | A1 | 10/2002 |
| EP | 1 473 355 | A1 | 11/2004 |
| JP | 2002003886 | A * | 8/2002 |
| WO | WO 96/00274 | A | 1/1996 |
| WO | WO 02/12455 | A1 | 2/2002 |

OTHER PUBLICATIONS

U.S. Appl. No. 12/211,290, filed Sep. 16, 2008, Christopher Andrew Morrison et al.
PCT International Search Report, 3 Pages, Mail Mar. 2, 2009.

* cited by examiner

*Primary Examiner* — Mark Eashoo
*Assistant Examiner* — M. Reza Asdjodi
(74) *Attorney, Agent, or Firm* — John T. Dipre; Amy I. Ahn-Roll; Steven W. Miller

(57) ABSTRACT

Liquid compositions for cleaning hard-surfaces having pH comprised between 3 and 4, obtained upon the mixing of an acid agent having a pKa comprised between 4 and 6, a source of alkalinity and a surfactant system. Process for treating hard surfaces, preferably delicate, hard surfaces, by applying said composition onto said hard surface and the use of said composition for cleaning hard surface while maintaining surface safety.

16 Claims, No Drawings

LIQUID ACIDIC HARD SURFACE CLEANING COMPOSITION

TECHNICAL FIELD

The present invention relates to liquid compositions for cleaning hard-surfaces. More specifically, the present invention relates to liquid compositions, which deliver an improved performance in removing limescale and which, at the same times, provide safety to the surface treated.

BACKGROUND OF THE INVENTION

Liquid compositions for cleaning hard-surfaces have been disclosed in the art. Much of the focus for such compositions has been on providing outstanding cleaning performances on a variety of soils and surfaces and, more particularly, to provide improved performance on the removal of limescale.

Tap water contains a certain amount of solubilized ions which, upon water evaporation, eventually deposit salts, such as calcium carbonate, on hard-surfaces which are often in contact with water, resulting in an anesthetic aspect of the surfaces. This limescale formation and deposition phenomenon is even more acute in places where water is particularly hard.

It is known to use acidic compositions to clean hard surfaces and that such formulations show good overall cleaning performance and good limescale removal performance.

However, there are some limitations to the convenience of acidic compositions employed as hard surface cleaner. Indeed, it is known that some hard surfaces, such as enamel and several metals, e.g. stainless steel and aluminum, are sensitive to acids and may be severely damaged by acidic compositions used to clean said surfaces.

Thus, there is a constant need for the development of cleaning compositions which have improved cleaning performance, especially on greasy soap scum soils, and in the same time, having excellent limescale removal performance, without damaging the hard surface treated herein.

Therefore, the objective of the present invention is to provide compositions which are well adapted to treat delicate surfaces while delivering also improved cleaning performance, especially on greasy soap scum soils.

It has now been surprisingly found that the above objective is met by providing a liquid composition, having pH of 3 to 4, and comprising an acid agent having a pKa of 4 to 6. An essential feature of this composition is also that it contains a source of alkalinity.

Indeed, the composition of the present invention provides good cleaning performance, in particular, improved limescale removal performances, when applied to hard-surfaces without damaging the treated surface. Thus, an advantage of the present invention is that it provides improved cleaning performance, especially on greasy soap scum soils and on limescale, while being safe to hard surface, especially to delicate surfaces.

Indeed, an advantage of the present invention is that the liquid compositions show good stain/soil removal performance on various types of stains/soils in particular: greasy soils, e.g., greasy soap scum; limescale; mold; mildew; and other tough stains found on surfaces. In particular, the composition is safe to said surfaces while exhibiting a good cleaning performance on limescale-containing stains.

Another advantage of the present invention is that the composition is safe for the person who uses it, i.e., said composition is not too aggressive toward the human skin.

Advantageously, the composition of the present invention may be used on various delicate hard surfaces. Delicate surfaces are, for example, linoleum, plastic, plastified wood, metal, enamel or varnished surfaces. Enamel and plastic surfaces can be found in various places, e.g., in households: in kitchens (sinks and the like); in bathrooms (tubs, sinks, shower tiles, bathroom enamelware and the like) . . . . The composition of the present invention may also be used to clean hard surfaces made of a variety of materials like glazed and non-glazed ceramic tiles, stainless steel, Inox®, Formica®, aluminum, vinyl, no-wax vinyl, linoleum, melamine, all plastics and plastified wood. The composition of the present invention is advantageously used on delicate hard surface, more preferably on enamel, stainless steel and/or aluminum.

Another object of the present invention is to provide a process for cleaning hard surfaces, more specifically delicate hard surfaces, with the composition of the present invention. The process of the present invention provides outstanding limescale performance while being safe to the surface treated in the same tine with an improved cleaning performance, especially on greasy soap scum soils.

BACKGROUND ART

The following documents are representative of the prior art available on liquid hard surface cleaning compositions.

WO 99/32596 discloses a composition containing stabilized acidic chlorine bleach, this composition being useful for the removal of limescale for hard surfaces.

WO 2001/057174 relates to an aqueous hard surface cleaning and disinfecting composition comprising an acid sequestrant constituent and a mixture of hydrophobic and hydrophilic solvent.

SUMMARY OF THE INVENTION

The present invention encompasses a hard surface liquid cleaning composition having a pH of 3 to 4, obtained upon the mixing of an acid agent having a pKa comprised between 4 and 6, a source of alkalinity and a surfactant system. The present invention also encompasses a process for treating hard surfaces, preferably delicate hard surfaces, by applying said composition onto said hard surface and the use of said composition for cleaning hard surface while maintaining surface safety.

DETAILED DESCRIPTION OF THE INVENTION

The objective of the present invention is to provide a composition suitable for treating hard surface; more especially, for removing limescale from a hard-surface, which exhibits outstanding cleaning performance, and which is in the same time safe for the hard surface treated herein.

The Liquid Hard-Surface Cleaning Composition

The compositions according to the present invention are designed as hard-surface cleaners, preferably as hard-surface cleaners for delicate surfaces.

The liquid compositions according to the present invention are preferably aqueous compositions. Therefore, they may comprise from 50% to 99%, preferably from 75% to 95% and more preferably from 80 to 95% by weight of the total composition of water.

An essential feature of the present invention, is that the liquid compositions of the present invention is acidic and have a pH comprised between 3 and 4, preferably from 3.1 to 3.9, more preferably from 3.2 to 3.9, even more preferably 3.5 to 4.0, and most preferably from 3.6 to 3.9. The pH of the cleaning compositions herein, as is measured at 25° C., is at least 3, with increasing preference in the order given, 3.1, 3.2, 3.3, 3.4, or 3.5. The pH of the cleaning compositions herein, as is measured at 25° C., is no more than 4, preferably with increasing preference in the order given, 4, 3.9, 3.8, 3.7 or 3.6.

Indeed, the Applicant has found that by using a composition having a pH comprised between 3 and 4, the pH of said composition is in an optimal range to achieve good cleaning performance whilst still being safe to the treated hard surface. Indeed, a composition having a pH below 3 will not be safe to the treated hard surface and a composition having a pH above 4 will not be enough performing in term of cleaning hard surface.

Thus, the compositions of the present invention have excellent cleaning performance on hard surfaces while being safe to said hard surface. Even more, the compositions of the present invention provide excellent limescale removal while being safe to delicate hard surfaces, such as enamel, stainless steel, aluminum etc.

By "safe to hard surfaces" it is meant herein that the compositions as described herein prevent or at least reduce damage to surfaces treated therewith as compared to other acidic compositions, especially acidic composition having a pH below 3.

It is believed that damage to vitreous enamel or other ceramic surfaces may be caused by ions exchanges between the metal ions in the enamel network and the hydrogen ions present in acidic compositions. The lower is the pH the higher is the corrosion rate. The ions are believed to penetrate and spread through the superficial layers of the crystalline lattice of enamel or other ceramic surfaces. The result of such a replacement is that the enamel surface eventually looses its smoothness and consequently its gloss, i.e., shine. These loss are perceived by consumers as damage to hard surfaces.

The acid agent, according to the present invention, are weak acid. This weak acid are characterized by an acid dissociation constant, $K_a$, which is an equilibrium constant for the dissociation of a weak acid; the pKa, being equal to minus the decimal logarithm of $K_a$.

The acid agent can be a monoprotic acid or a polyprotic acid. Polyprotic acids have more than one proton to dissociate, have several constant of dissociation and thus have several pKa denoted as $pKa_1$, for the first pKa, and $pKa_2$, etc. . . . for the constants for dissociation of other successive protons. It is generally true that successive pK values increase.

Therefore, according to the present invention, the pKa of the acid agent, when the acid agent is a polyprotic agent, means herein the first pKa; in other word the pKa with lower value.

As an essential ingredient, the composition, according to the present invention, i.e. having a pH comprised between 3 and 4, is obtained with the use of an acid agent having a pKa comprised between 4 and 6.

Said acid agent has a pKa comprised between 4.0 and 6.0; preferably comprised between 4.3 and 5.7; more preferably between 4.5 and 5, even more preferably between 4.7 and 4.9.

In a preferred embodiment the acid agent will be a polyprotic acid having a first pKa comprised between 4 and 6. In a more preferred embodiment the acid agent will be a monoprotic acid having a pKa comprised between 4 and 6.

Typically the compositions of the present invention may comprise from 0.1% to 25%, preferably from 1% to 20% and more preferably from 3% to 15% by weight of the total composition of said acid agent.

Indeed, the Applicant has found that by using an acid agent having a pKa comprised between 4 and 6, in a composition having a pH comprised between 3 and 4, the pKa of said acid agent is in an optimal range to achieve good cleaning performance whilst still being safe to the treated hard surface. Indeed, an acid agent having a pKa above 6 or below will not be enough performing in term of cleaning hard surface when using a composition having a pH of 3 to 4.

Thus, it has been unexpectedly found that liquid cleaning compositions having a pH comprised between 3 and 4 and comprising the acid agent according to the present invention provide improved cleaning performance, more especially an improved limescale cleaning performance, as compared to the cleaning performance obtained with the same compositions but with other acid agent.

Indeed, liquid cleaning compositions having a pH of 3 to 4 and comprising the acid agent according to the present invention, are safe to the surface treated therein, as compared to the safety performance obtained with the same compositions but with other acid agent.

Even more, liquid cleaning compositions comprising the acid agent according to the present invention and having a pH comprised between 3 and 4, provide improved cleaning performance, more especially an improved limescale cleaning performance, while maintaining excellent safety to the hard surface treated as compared to the cleaning performance and safety performance obtained with the same compositions but at different pH.

This unexpected cleaning performance in combination with the excellent safety profile is obtained with the composition according to the present invention, i.e. with a liquid cleaning composition having a pH of 3 to 4, comprising an acid agent having a pKa comprised between 4 and 6.

Suitable acid agents having a pKa comprised between 4 and 6, are preferably water-soluble acid agents.

Examples of suitable acid agents are selected form the group consisting of: acetic acid; acrylic acid; ascorbic acid; glutaric acid; adipamic acid; adipic acid; anisylpropionic acid; barbituric acid; butyric acid; caproic acid; b-chlorobutyric acid; g-chlorobutyric acid; chlorocinnamic acid; cinnamic acid; crotonic acid; glutaramic acid; heptanoic acid; hexanoic acid; hydroxybutyric acid; b-hydroxypropionic acid; mesitylenic acid; methylcinnamic acid; methylglutaric acid; methylsuccinic acid; octanoic acid; pimelic acid; propionic acid; suberic acid; succinic acid; and valeric acid; nonanoic acid, trimethylacetic acid, vinylacetic acid, tetraboric acid, anisic acid, gallic acid, m-aminobenzoic acid; p-aminobenzoic acid; benzoic acid; m-brombenzoic acid; m-chlorophenylacetic acid; p-chlorophenylacetic acid; b-(o-chlorophenyl)propionic acid; b-(m-chlorophenyl)propionic acid; b-(p-chlorophenyl)propionic acid 3,4-dihydroxybenzoic acid; 3,5-dihydroxybenzoic acid; 2,4-dinitrophenol; 3,6-dinitrophenol; ethylphenylacetic acid; ethylbenzoic acid, hexahydrobenzoic acid; m-hydroxybenzoic acid; p-hydroxybenzoic acid; b-naphtoic acid; o-b-nitrophenylpropionic acid; p-b-nitrophenylpropionic acid; phenylacetic acid; g-phenylbutyric acid; a-phenylpropionic acid; b-phenylpropionic acid; m-toluic acid; and p-toluic acid; isopropylbenzoic; mathylamino benzoic; and mixtures thereof.

Even more preferably, the acid agent is selected form the group consisting of acetic acid; acrylic acid; ascorbic acid; glutaric acid; adipic acid; butyric acid; crotonic acid; hydroxybutyric acid, b-hydroxypropionic acid; methylglutaric acid; methylsuccinic acid; propionic acid; vinylacetic acid, valeric acid; succinic acid; p-Chloroacetic acid; b-phenylpropionic acid and mixtures thereof. Suitable acids are commercially available from Aldrich, ICI or BASF.

In a even more preferred embodiment of the present invention, the acid agent is selected form the group constituting of acetic acid, propionic acid, vinylacetic acid, acrylic acid; ascorbic acid, valeric acid, glutaric acid, hydroxybutyric; hydroxypropionic or mixtures thereof.

Yet more preferably, the acid agent is selected form the group consisting of acetic acid; glutaric acid; adipic acid; succinic acid; propionic acid and mixtures thereof.

In a still more preferred embodiment of the present invention, the acid agent is selected form the group constituting of acetic acid, propionic acid or mixtures thereof.

In a most preferred embodiment of the present invention, the acid agent is acetic acid.

Another essential feature is that the present invention is that the composition is obtained with the use of a source of alkalinity. The source of alkalinity being used herein to adjust the composition to a pH comprised between 3 and 4.

Preferably, a proviso of the present invention is that the compositions does not contain, as source of alkalinity, magnesium carbonate or calcium carbonate. Indeed, an essential feature of the present invention is that the source of alkalinity must not be created during the use of the composition, but added to the composition before.

Indeed, the magnesium carbonate or calcium carbonate are not part of the source of alkalinity according to the present invention, as these components can be created upon contact, of an acidic composition, with limescale which can be constitutive of $CaCO_3$ and of $MgCO_3$.

Suitable sources of alkalinity for use herein are the caustic alkalis, such as sodium hydroxide, potassium hydroxide and/or lithium hydroxide, and/or the alkali metal oxides such, as sodium and/or potassium oxide or mixtures thereof and/or alkali metal carbonates or bicarbonates such as sodium or potassium carbonate/bicarbonate. Other suitable bases include ammonia, ammonium carbonate and hydrogen carbonate, choline base, etc. Preferably, source of alkalinity is sodium hydroxide or potassium hydroxide, preferably potassium hydroxide.

The source of alkalinity will be present tin the composition of the present invention in a amount needed to trim the pH to the desired value, i.e. to a pH between 3 and 4.

Typically the amount of source of alkalinity are of from 0.001% to 20% by weight, preferably from 0.01% to 10% and more preferably from 0.1% to 2% by weight of the composition.

The amount of source of alkalinity depending of the amount of acid used. As for example, when using acetic acid in the range comprised between 0.1% and 20%, the amount of sodium hydroxide will be comprised between 0.004% to 1.5%.

Surfactants

The compositions according to the present invention is obtained with the use, as an essential ingredient, of a surfactant system.

All types of surfactants may be used in the composition of the present invention. The surfactant system such as disclosed herein include nonionic, anionic, cationic, amphoteric or zwitterionic surfactants or a mixture thereof.

Accordingly, the compositions of the present invention comprise up to 30%, preferably of from 0.1% to 20%, more preferably of from 1% to 10%, and most preferably of from 1% to 5% by weight of the total composition of a surfactant systems.

Suitable cationic surfactants to be used herein include derivatives of quaternary ammonium, phosphonium, imidazolium and sulfonium compounds. Preferred cationic surfactants for use herein are quaternary ammonium compounds wherein one or two of the hydrocarbon groups linked to nitrogen are a saturated, linear or branched alkyl group of 6 to 30 carbon atoms, preferably of 10 to 25 carbon atoms, and more preferably of 12 to 20 carbon atoms, and wherein the other hydrocarbon groups (i.e. three when one hydrocarbon group is a long chain hydrocarbon group as mentioned hereinbefore or two when two hydrocarbon groups are long chain hydrocarbon groups as mentioned hereinbefore) linked to the nitrogen are independently substituted or unsubstituted, linear or branched, alkyl chain of from 1 to 4 carbon atoms, preferably of from 1 to 3 carbon atoms, and more preferably are methyl groups.

In the preferred embodiment of the present invention where persulfate salts or mixtures thereof are used as sources of active oxygen, the quaternary ammonium compound is preferably a non-chloride/non halogen quaternary ammonium compound. The counterion used in said quaternary ammonium compounds are compatible with any source of active oxygen and are selected from the group of methyl sulfate, or methylsulfonate, and the like.

Particularly preferred to be used in the compositions of the present invention are trimethyl quaternary ammonium compounds like myristyl trimethylsulfate, cetyl trimethylsulfate and/or tallow trimethylsulfate. Such trimethyl quaternary ammonium compounds are commercially available from Hoechst, or from Albright & Wilson under the trade name EMPIGEN CM®.

Suitable amphoteric surfactants to be used in the compositions according to the present invention include amine oxides having the following formula $R_1R_2R_3NO$ wherein each of $R_1$, $R_2$ and $R_3$ is independently a saturated substituted or unsubstituted, linear or branched alkyl groups of from 1 to 30 carbon atoms, preferably of from 6 to 30 carbon atoms, more preferably of from 10 to 20 carbon atoms, and most preferably of from 8 to 18 carbon atoms. Suitable amine oxides for use herein are preferably compatible with source of active oxygen. Preferred amine oxides for use herein are for instance natural blend $C_8$-$C_{10}$ amine oxides as well as $C_{12}$-$C_{16}$ amine oxides commercially available from Hoechst.

Suitable short chain amine oxides to be used according to the present invention are amine oxides having the following formula $R^1R^2R^3NO$ wherein $R^1$ is a $C_6$ to $C_{10}$ alkyl group, preferably a $C_8$ to $C_{10}$ alkyl group and wherein $R^2$ and $R^3$ are independently substituted or unsubstituted, linear or branched alkyl groups of from 1 to 4 carbon atoms, preferably of from 1 to 3 carbon atoms, and more preferably are methyl groups. $R^1$ may be a saturated linear or branched alkyl group. Suitable short chain amine oxides for use herein are preferably compatible with any source of active oxygen. Preferred short chain amine oxides for use herein are for instance natural blend $C_8$-$C_{10}$ amine oxides available from Hoechst.

Suitable nonionic surfactants to be used herein are alkoxylated fatty alcohol nonionic surfactants that can be readily made by condensation processes that are well known in the art. Indeed, a great variety of such alkoxylated fatty alcohols are commercially available which have very different HLB values. The HLB values of such alkoxylated nonionic surfactants depend essentially on the chain length of the fatty alcohol, the nature of the alkoxylation and the degree of alkoxylation. Hydrophilic nonionic surfactants tend to have a high degree of alkoxylation and a short chain fatty alcohol, while hydrophobic surfactants tend to have a low degree of alkoxylation and a long chain fatty alcohol. Surfactants catalogues are available which list a number of surfactants including nonionics, together with their respective HLB values.

Accordingly, preferred alkoxylated alcohols for use herein are nonionic surfactants according to the formula $RO(E)_e(P)_pH$ where R is a hydrocarbon chain of from 2 to 24 carbon atoms, E is ethylene oxide and P is propylene oxide, and e and p which represent the average degree of, respectively ethoxylation and propoxylation, are of from 0 to 24. The hydrophobic moiety of the nonionic compound can be a primary or secondary, straight or branched alcohol having from 8 to 24 carbon atoms. Preferred nonionic surfactants for use in the compositions according to the invention are the condensation products of ethylene oxide with alcohols having a straight alkyl chain, having from 6 to 22 carbon atoms, wherein the degree of ethoxylation is from 1 to 15, preferably from 5 to 12. Such suitable nonionic surfactants are commercially available from Shell or under the trade name Neodol®; or for instance, under the trade name Dobanol®. These nonionics are preferred because they have been found to allow the formulation of a stable product without requiring the addition of stabilisers or hydrotropes. When using other nonionics, it may be necessary to add hydrotropes such as cumene sulphonate or solvents such as butyldiglycolether.

Other suitable anionic surfactants are alkyl-diphenyl-ether-sulphonates and alkyl-carboxylates. Other, suitable anionic surfactants herein include water soluble salts or acids of the formula $ROSO_3M$ wherein R is preferably a $C_{10}$-$C_{24}$ hydrocarbyl, preferably an alkyl or hydroxyalkyl having a $C_{10}$-$C_{20}$ alkyl component, more preferably a $C_{12}$-$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Other anionic surfactants useful for detersive purposes can also be used herein. These can include salts (including, for example, sodium, potassium, ammonium, and substituted ammonium salts such as mono-, di- and triethanolamine salts) of soap, $C_9$-$C_{20}$ linear alkylbenzenesulfonates, $C_8$-$C_{22}$ primary or secondary alkanesulfonates, $C_8$-$C_{24}$ olefinsulfonates, sulfonated polycarboxylic acids prepared by sulfonation of the pyrolyzed product of alkaline earth metal citrates, e.g., as described in British patent specification No. 1,082,179, $C_8$-$C_{24}$ alkylpolyglycolethersulfates (containing up to 10 moles of ethylene oxide); alkyl ester sulfonates such as $C_{14-16}$ methyl ester sulfonates; acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}$-$C_{18}$ monoesters) diesters of sulfosuccinate (especially saturated and unsaturated $C_6$-$C_{14}$ diesters), acyl sarcosinates, sulfates of alkylpolysaccharides such as the sulfates of alkylpolyglucoside (the nonionic non-sulfated compounds being described below), branched primary alkyl sulfates, alkyl polyethoxy carboxylates such as those of the formula $RO(CH_2CH_2O)_kCH_2COO^-M^+$ wherein R is a $C_8$-$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Preferred anionic surfactants for use in the compositions herein are the alkyl benzene sulfonates, alkyl sulfates, alkyl alkoxylated sulfates, and mixtures thereof.

Optional Ingredients

The compositions according to the present invention may comprise a variety of optional ingredients depending on the technical benefit aimed for and the surface treated.

Suitable optional ingredients for use herein include chelating agents, vinylpyrrolidone homopolymer or copolymer, surface modifying polymers, silicone polymer, polysaccharide polymer, radical scavengers, perfumes, solvents, builders, buffers, hydrotropes, colorants, stabilizers, bleaches, bleach activators, suds controlling agents like fatty acids, enzymes, soil suspenders, dye transfer agents, brighteners, anti dusting agents, dispersants, dye transfer inhibitors, pigments, caustic, dyes.

The compositions according to the present invention may also comprise an additional acid having a pKa value comprised between 3 and 4. Example of suitable additional acids are selected form the group constituting of lactic acid, formic acid, for example.

Solvent

The compositions of the present invention may further comprise a solvent, as a highly preferred optional ingredient.

Solvents are desired herein because they contribute to the greasy soils cleaning performance of the composition herein.

Suitable solvents for use herein include glycols or alkoxylated glycols, alkoxylated aromatic alcohols, aromatic alcohols, aliphatic branched alcohols, alkoxylated aliphatic branched alcohols, alkoxylated linear $C_1$-$C_5$ alcohols, linear $C_1$-$C_5$ alcohols, $C_8$-$C_{14}$ alkyl and cycloalkyl hydrocarbons and halohydrocarbons and mixtures thereof with the proviso that said solvent is not a mono-lower alkyl ether or phenyl ether or benzyl ether of diethylene glycol, wherein the lower alkyl is of 2 to 6 carbon atoms.

Suitable glycols to be used herein are according to the formula $HO—CR_1R_2—OH$ wherein $R_1$ and $R_2$ are independently H or a $C_2$-$C_{10}$ saturated or unsaturated aliphatic hydrocarbon chain and/or cyclic. Suitable glycols to be used herein are dodecaneglycol and/or propanediol.

Suitable alkoxylated glycols to be used herein are according to the formula $R\text{-}(A)_n\text{-}R_1—OH$ wherein R is H, OH, a linear saturated or unsaturated alkyl of from 1 to 20 carbon atoms, preferably from 2 to 15 and more preferably from 2 to 10 carbon atoms, wherein $R_1$ is a linear saturated or unsaturated alkyl of from 3 to 20 carbon atoms, preferably from 3 to 15 and more preferably from 3 to 10 carbon atoms, and A is an alkoxy group preferably ethoxy, methoxy, and/or propoxy and n is from 1 to 5, preferably 1 to 2. Suitable alkoxylated glycols to be used herein are methoxy octadecanol and/or ethoxyethoxyethanol.

Suitable alkoxylated aromatic alcohols to be used herein are according to the formula $R\text{-}(A)_n\text{-}OH$ wherein R is an alkyl substituted or non-alkyl substituted aryl group of from 1 to 20 carbon atoms, preferably from 2 to 15 and more preferably from 2 to 10 carbon atoms, wherein A is an alkoxy group preferably butoxy, propoxy and/or ethoxy, and n is an integer of from 1 to 5, preferably 1 to 2, with the proviso that n is not an integer of 2 if A is an ethoxy group. Suitable alkoxylated aromatic alcohols are benzoxyethanol and/or benzoxypropanol.

Suitable aromatic alcohols to be used herein are according to the formula R—OH wherein R is an alkyl substituted or non-alkyl substituted aryl group of from 1 to 20 carbon atoms, preferably from 1 to 15 and more preferably from 1 to 10 carbon atoms. For example a suitable aromatic alcohol to be used herein is benzyl alcohol.

Suitable aliphatic branched alcohols to be used herein are according to the formula R—OH wherein R is a branched saturated or unsaturated alkyl group of from 1 to 20 carbon atoms, preferably from 2 to 15 and more preferably from 5 to 12 carbon atoms. Particularly suitable aliphatic branched alcohols to be used herein include 2-ethylbutanol and/or 2-methylbutanol.

Suitable alkoxylated aliphatic branched alcohols to be used herein are according to the formula R-$(A)_n$-OH wherein R is a branched saturated or unsaturated alkyl group of from 1 to 20 carbon atoms, preferably from 2 to 15 and more preferably from 5 to 12 carbon atoms, wherein A is an alkoxy group preferably butoxy, propoxy and/or ethoxy, and n is an integer of from 1 to 5, preferably 1 to 2. Suitable alkoxylated aliphatic branched alcohols include 1-methylpropoxyethanol and/or 2-methylbutoxyethanol.

Suitable alkoxylated linear $C_1$-$C_5$ alcohols to be used herein are according to the formula R-$(A)_n$-OH wherein R is a linear saturated or unsaturated alkyl group of from 1 to 5 carbon atoms, preferably from 2 to 4 carbon atoms, wherein A is an alkoxy group preferably butoxy, propoxy and/or ethoxy, and n is an integer of from 1 to 5, preferably 1 to 2, with the proviso that n is not an integer of 2 if A is an ethoxy group. Suitable alkoxylated aliphatic linear $C_1$-$C_5$ alcohols are butoxy propoxy propanol (n-BPP), butoxyethanol, butoxypropanol, ethoxyethanol or mixtures thereof. Butoxy propoxy propanol is commercially available under the trade name n-BPP® from Dow chemical.

Suitable linear $C_1$-$C_5$ alcohols to be used herein are according to the formula R—OH wherein R is a linear saturated or unsaturated alkyl group of from 1 to 5 carbon atoms, preferably from 2 to 4 carbon atoms. Suitable linear $C_1$-$C_5$ alcohols are methanol, ethanol, propanol or mixtures thereof. Other suitable solvents include butyltriglycol ether, ter amilic alcohol and the like. Particularly preferred solvents to be used herein are butoxy propoxy propanol, benzyl alcohol, butoxypropanol, ethanol, methanol, isopropanol and mixtures thereof.

The preferred solvent for use herein is butoxy propoxy propanol (n-BPP). Typically, the compositions of the present invention may comprise from 0.1% to 8%, preferably from 0.5% to 5% and more preferably from 1% to 3% by weight of the total composition of a solvent.

Vinylpyrrolidone Homopolymer or Copolymer

The compositions of the present invention may comprise a vinylpyrrolidone homopolymer or copolymer.

The advantage of the composition of present invention, when containing this specific copolymer, is that it provides, in addition to outstanding limescale removal performance, soil repellency properties when the composition is applied to hard surface, meaning that the composition, when containing this specific copolymer, will prevent or at least reduce the deposition of soil after an initial cleaning operation.

Typically, the compositions of the present invention may comprise from 0.01% to 5%, more preferably from 0.05% to 3% and most preferably from 0.05% to 1% by weight of the total composition of a vinylpyrrolidone homopolymer or copolymer.

Suitable vinylpyrrolidone homopolymers for use herein are homopolymers of N-vinylpyrrolidone having the following repeating monomer:

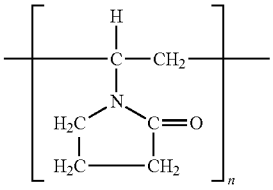

wherein n (degree of polymerisation) is an integer of from 10 to 1,000,000, preferably from 20 to 100,000, and more preferably from 20 to 10,000.

Accordingly, suitable vinylpyrrolidone homopolymers ("PVP") for use herein have an average molecular weight of from 1,000 to 100,000,000, preferably from 2,000 to 10,000,000, more preferably from 5,000 to 1,000,000, and most preferably from 50,000 to 500,000.

Suitable vinylpyrrolidone homopolymers are commercially available from ISP Corporation, New York, N.Y. and Montreal, Canada under the product names PVP K-15® (viscosity molecular weight of 10,000), PVP K-30® (average molecular weight of 40,000), PVP K-60® (average molecular weight of 160,000), and PVP K-90® (average molecular weight of 360,000). Other suitable vinylpyrrolidone homopolymers which are commercially available from BASF Cooperation include SokalanHP165®, SokalanHP12®, Luviskol K30®, Luviskol K60®, Luviskol K80®, Luviskol K90® and other vinylpyrrolidone homopolymers known to persons skilled in the detergent field (see for example EP-A-262,897 and EP-A-256,696).

Suitable copolymers of vinylpyrrolidone for use herein include copolymers of N-vinylpyrrolidone and alkylenically unsaturated monomers or mixtures thereof.

The alkylenically unsaturated monomers of the copolymers herein include unsaturated dicarboxylic acids such as maleic acid, chloromaleic acid, fumaric acid, itaconic acid, citraconic acid, phenylmaleic acid, aconitic acid, acrylic acid, N-vinylimidazole and vinyl acetate. Any of the anhydrides of the unsaturated acids may be employed, for example acrylate, methacrylate. Aromatic monomers like styrene, sulphonated styrene, alpha-methyl styrene, vinyl toluene, t-butyl styrene and similar well-known monomers may be used.

The molecular weight of the copolymer of vinylpyrrolidone is not especially critical so long as the copolymer is water-soluble, has some surface activity and is adsorbed to the hard-surface from the liquid composition comprising it in such a manner as to increase the hydrophilicity of the surface. However, the preferred copolymers of N-vinylpyrrolidone and alkylenically unsaturated monomers or mixtures thereof, have a molecular weight of between 1,000 and 1,000,000, preferably between 10,000 and 500,000 and more preferably between 10,000 and 200,000.

For example particularly suitable N-vinylimidazole N-vinylpyrrolidone polymers for use herein have an average molecular weight range from 5,000 to 1,000,000, preferably from 5,000 to 500,000, and more preferably from 10,000 to 200,000. The average molecular weight range was determined by light scattering as described in Barth H. G. and Mays J. W. Chemical Analysis Vol 113, "Modem Methods of Polymer Characterization".

Such copolymers of N-vinylpyrrolidone and alkylenically unsaturated monomers like PVP/vinyl acetate copolymers are commercially available under the trade name Luviskol® series from BASF.

The copolymers of vinylpyrrolidone for use in the compositions of the present invention also include quaternized or unquaternized vinylpyrrolidone/dialkylaminoalkyl acrylate or methacrylate copolymers.

Such vinylpyrrolidone/dialkylaminoalkyl acrylate or methacrylate copolymers (quaternised or unquaternised) suitable to be used in the compositions of the present invention are according to the following formula:

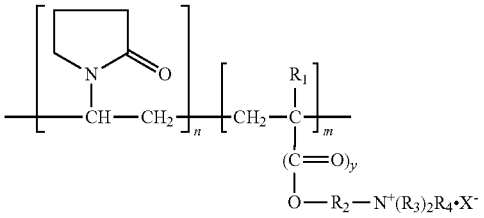

in which n is between 20 and 99 and preferably between 40 and 90 mol % and m is between 1 and 80 and preferably between 5 and 40 mol %; $R_1$ represents H or $CH_3$; y denotes 0 or 1; $R_2$ is —$CH_2$—CHOH—$CH_2$— or $C_xH_{2x}$, in which x=2 to 18; $R_3$ represents a lower alkyl group of from 1 to 4 carbon atoms, preferably methyl or ethyl, or

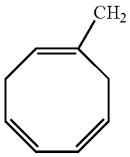

$R_4$ denotes a lower alkyl group of from 1 to 4 carbon atoms, preferably methyl or ethyl; $X^-$ is chosen from the group consisting of Cl, Br, I, ½ $SO_4$, $HSO_4$ and $CH_3SO_3$. The polymers can be prepared by the process described in French Pat. Nos. 2,077,143 and 2,393,573.

The preferred quaternized or unquaternized vinylpyrrolidone/dialkylaminoalkyl acrylate or methacrylate copolymers for use herein have a molecular weight of between 1,000 and 1,000,000, preferably between 10,000 and 500,000 and more preferably between 10,000 and 100,000.

Such vinylpyrrolidone/dialkylaminoalkyl acrylate or methacrylate copolymers are commercially available under the name copolymer 845®, Gafquat 734®, or Gafquat 755® from ISP Corporation, New York, N.Y. and Montreal, Canada or from BASF under the tradename Luviquat®.

Preferred vinylpyrrolidone homopolymers or copolymers for use herein are the vinylpyrrolidone homopolymers.

Water-Soluble or Water-Dispersible Copolymer

The compositions of the present invention may comprise water-soluble or water-dispersible copolymer.

The water-soluble or water-dispersible copolymer can be either a water-soluble or water-dispersible copolymer I as described below or a water-soluble or water-dispersible copolymer II as described herein below.

The water-soluble or water-dispersible copolymer I of the present invention comprises, in the form of polymerized units:

a) at least a monomer compound of general formula i:

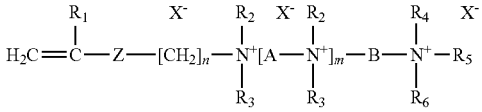

(i)

in which $R_1$ is a hydrogen atom, a methyl or ethyl group;

$R_2$, $R_3$, $R_4$, $R_5$ and $R_6$, which are identical or different, are linear or branched $C_1$-$C_6$, alkyl, hydroxyalkyl or aminoalkyl groups;

m is an integer from 0 to 10;

n is an integer from 1 to 6;

Z represents a —C(O)O— or —C(O)NH— group or an oxygen atom;

A represents a $(CH_2)_p$ group, p being an integer from 1 to 6;

B represents a linear or branched $C_2$-$C_{12}$, polymethylene chain optionally interrupted by one or more heteroatoms or heterogroups, and optionally substituted by one or more hydroxyl or amino groups;

$X^-$, which are identical or different, represent counterions; and (b) at least one hydrophilic monomer carrying a functional acidic group which is copolymerizable with (a) and which is capable of being ionized in the application medium;

(c) optionally at least one monomer compound with ethylenic unsaturation with a neutral charge which is copolymerizable with (a) and (b), preferably a hydrophilic monomer compound with ethylenic unsaturation with a neutral charge, carrying one or more hydrophilic groups, which is copolymerizable with (a) and (b).

The monomer (a) can be prepared, for example, according to the reaction schemes shown in U.S. Pat. No. 6,569,261 to Rhodia, column 2, line 40 to column 3, line 45 which is incorporated herein by reference.

Preferably, in the general formula (i) of the monomer (a), Z represents C(O)O, C(O)NH or O, very preferably C(O)NH; n is equal to 2 or 3, very particularly 3; m ranges from 0 to 2 and is preferably equal to 0 or 1, very particularly to 0; B represents —CH2-CH(OH)—$(CH2)_q$, with q from 1 to 4, preferably equal to 1; $R_1$ to $R_6$, which are identical or different, represent a methyl or ethyl group.

The water-soluble or water-dispersible copolymer II of the present invention comprises, in the form of polymerized units:

d) at least a monomer compound of general formula ii:

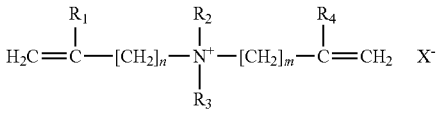

(ii)

in which:

R1 and R4 independently represent H or a C1-6 linear or branched alkyl group;

R2 and R3 independently represent a linear or branched C1-6 alkyl, hydroxyalkyl or aminoalkyl group, preferably a methyl group;

n and m are integers of between 1 and 3;

$X^-$ represents a counterion compatible with the water-soluble or water-dispersible nature of the polymer;

e) at least one hydrophilic monomer with an acid functionality that is copolymerisable with monomer d) and capable of ionizing in the medium in which it is used; and f) optionally an ethylenically unsaturated hydrophilic monomer compound of neutral charge bearing one or several hydrophilic groups which is copolymerisable with monomers d) and e); the monomer d) to monomer e) ratio ranging from between 60:40 and 5:95.

More preferably, $R_1$ represents hydrogen, $R_2$ represents methyl, $R_3$ represents methyl, $R_4$ represents hydrogen, and m and n are equal to 1. The ion $X^-$ is preferably chosen from halogen, sulfate, hydrogen sulfate, phosphate, citrate, formate and acetate.

Suitable water-soluble or water-dispersible copolymer which can be used herein are more described in European patent application 06 112 673.61.

Silicone Polymer

The liquid composition according to the present invention may further comprise a silicone polymer as an optional but highly preferred ingredient.

The composition herein may comprise up to 50%, more preferably of from 0.01% to 30%, even more preferably of from 0.01% to 20%, and most preferably of from 0.01% to 10%, by weight of the total composition of said silicone polymer.

Suitable silicone polymers are selected from the group consisting of silicone glycol polymers and mixtures thereof. In a preferred embodiment according to the present invention, the silicone polymer herein is a silicone glycol polymer. Depending on the relative position of the silicone-polyether chains, the silicone glycol polymer can be either linear or grafted.

Preferably, said silicone glycol polymer is according to the following formulae

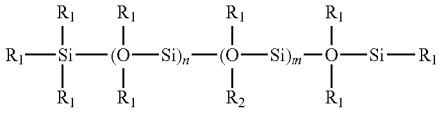

Grafted structure

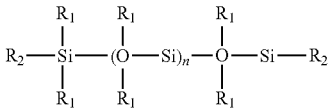

Linear structure wherein: each $R_1$ independently is H or a hydrocarbon radical; $R_2$ is a group bearing a polyether functional group; n is an integer of from 0 to 500; and for the grafted structure m is an integer of from 1 to 300, and preferably with n+m more than 1. In a highly preferred embodiment herein the silicone polymer herein is a grafted silicone glycol. Preferably, each $R_1$ independently is H or a hydrocarbon chain comprising from 1 to 16, more preferably a hydrocarbon chain comprising from 1 to 12 carbon atoms, and even more preferably $R_1$ is a $CH_3$-group. $R_1$ can also contain $NH_2$ groups and/or quaternary ammoniums. Preferably, n is an integer of from 0 to 100, more preferably an integer of from 1 to 100, even more preferably n is an integer of from 1 to 50, and most preferably n is an integer of from 5 to 30.

Preferably, m (for the grafted structure) is an integer of from 1 to 80, more preferably m is an integer of from 1 to 30, and even more preferably m is an integer of from 2 to 10. Preferably, n+m is more than 2.

Preferably, $R_2$ is an alkoxylated hydrocarbon chain. More preferably, $R_2$ is according to the general formulae:

$$—R_3\text{-}(A)_p\text{-}R_4 \text{ or } \text{-}(A)_p\text{-}R_4$$

wherein: $R_3$ is a hydrocarbon chain; A is an alkoxy group or a mixture thereof, p is an integer of from 1 to 50; and $R_4$ is H or a hydrocarbon chain, or —COOH.

Preferably, $R_3$ is a hydrocarbon chain comprising from 1 to 12, more preferably 3 to 10, even more preferably from 3 to 6, and most preferably 3 carbon atoms.

Preferably, A is an ethoxy or propoxy or butoxy unit or a mixture thereof, more preferably A is an ethoxy group. Preferably, p is an integer of from 1 to 50, more preferably p is an integer of from 1 to 30, and even more preferably p is an integer of from 5 to 20. Preferably, R4 is H or a hydrocarbon chain comprising from 1 to 12, more preferably 1 to 6, even more preferably from 3 to 6, and still even preferably 3 carbon atoms, most preferably R4 is H. Preferably, the silicone glycol polymers suitable herein have an average molecular weight of from 500 to 100,000, preferably from 600 to 50,000, more preferably from 1000 to 40,000, and most preferably from 2,000 to 20,000. Suitable, silicone glycol polymers are commercially available from General electric, Dow Corning, and Witco (see Applicant's co-pending European Patent Applications 03 447 099.7 and 03 447 098.9 for an extensive list of trade names of silicone glycol polymers). In a highly preferred embodiment according to the present invention, the polymer herein is a Silicones-Polyethers copolymer, commercially available under the trade name SF 1288® from GE Bayer Silicones.

Polysaccharide Polymer

The compositions of the present invention may comprise a polysaccharide polymer.

Typically, the compositions of the present invention may comprise from 0.01% to 5%, more preferably from 0.05% to 3% and most preferably from 0.05% to 1% by weight of the total composition of a polysaccharide polymer.

Suitable polysaccharide polymers for use herein include substituted cellulose materials like carboxymethylcellulose, ethyl cellulose, hydroxyethyl cellulose, hydroxypropyl cellulose, hydroxymethyl cellulose, succinoglycan and naturally occurring polysaccharide polymers like xanthan gum, guar gum, locust bean gum, tragacanth gum or derivatives thereof, or mixtures thereof.

Particularly polysaccharide polymers for use herein are xanthan gum and derivatives thereof.

Xanthan gum and derivatives thereof may be commercially available for instance from Kelco under the trade name Keltrol RD®, Kelzan S® or Kelzan T®. Other suitable Xanthan gum is commercially available by Rhone Poulenc under the trade name Rhodopol T® and Rhodigel X747®. Succinoglycan gum for use herein is commercially available by Rhone Poulenc under the trade name Rheozan®.

Radical Scavenger

The compositions of the present invention may comprise a radical scavenger or a mixture thereof Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anysole, benzoic acid, toluic acid, catechol, t-butyl catechol, benzylamine, 1,1,3-tris(2-methyl-4-hydroxy-5-t-butylphenyl)butane, n-propyl-gallate or mixtures thereof and highly preferred is di-tert-butyl hydroxy toluene. Such radical scavengers like N-propyl-gallate may be commercially available from Nipa Laboratories under the trade name Nipanox S1®. Radical scavengers when used, are typically present herein in amounts up to 10% by weight of the total composition and preferably from 0.001% to 0.5% by weight. The presence of radical scavengers may contribute to the chemical stability of the acidic compositions of the present invention.

Bleach

The compositions according to the present invention may comprise, as an optional ingredient, bleach. Preferably, said bleach is selected from the group consisting of sources of active oxygen, hypohalite bleaches and mixtures thereof.

The bleach, preferably the source of active oxygen according to the present invention acts as an oxidising agent, it increases the ability of the compositions to remove colored stains and organic stains in general, to destroy malodorous molecules and to kill germs. In a preferred embodiment according to the present invention said bleach is a source of active oxygen or a mixture thereof. Suitable sources of active oxygen for use herein are water-soluble sources of hydrogen peroxide including persulfate, dipersulphate, persulfuric acid, percarbonates, metal peroxides, perborates, persilicate salts, and mixtures thereof, as well as hydrogen peroxide, and mixtures thereof. As used herein a hydrogen peroxide source refers to any compound that produces hydrogen peroxide when said compound is in contact with water. In addition, other classes of peroxides can be used as an alternative to hydrogen peroxide and sources thereof or in combination with hydrogen peroxide and sources thereof. Suitable classes include dialkylperoxides, diacylperoxides, preformed percarboxylic acids, organic and inorganic peroxides and/or hydroperoxides. Suitable organic or inorganic peracids for use herein are selected from the group consisting of: persulphates such as monopersulfate; peroxyacids such as diperoxydodecandioic acid (DPDA) and phthaloyl amino peroxycaproic acid (PAP); magnesium perphthalic acid; perlauric acid; perbenzoic and alkylperbenzoic acids; and mixtures thereof. Suitable hydroperoxides for use herein are selected from the group consisting of tert-butyl hydroperoxide, cumyl hydroperoxide, 2,4,4-trimethylpentyl-2-hydroperoxide, di-isopropylbenzene-monohydroperoxide, tert-amyl hydroperoxide and 2,5-dimethyl-hexane-2,5-dihydroperoxide and mixtures thereof. Such hydroperoxides have the advantage to be particularly safe to carpets and carpet dyes while delivering excellent bleaching performance. Persulfate salts, or mixtures thereof, are the preferred sources of active oxygen to be used in the compositions according to the present invention. Preferred persulfate salt to be used herein is the monopersulfate triple salt. One example of monopersulfate salt commercially available is potassium monopersulfate commercialized by Peroxide Chemie GMBH under the trade name Curox®. Other persulfate salts such as dipersulphate salts commercially available from Peroxide Chemie GMBH can be used in the compositions according to the present invention. The compositions according to the present invention may comprise from 0.1% to 30%, preferably from 0.1% to 20%, more preferably from 1% to 10%, and most preferably from 1% to 7% by weight of the total composition of said bleach.

Chelating Agent

Another class of optional compounds for use herein includes chelating agents.

Chelating agents may be incorporated in the compositions herein in amounts ranging up to 10.0%, preferably 0.01% to 5.0% by weight of the total composition.

Suitable phosphonate chelating agents to be used herein may include alkali metal ethane 1-hydroxy diphosphonates (HEDP), alkylene poly (alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP). Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene. A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer, have been extensively described in U.S. Pat. No. 4,704,233, Nov. 3, 1987, to Hartman and Perkins. Ethylenediamine N,N'-disuccinic acid is, for instance, commercially available under the tradename ssEDDS® from Palmer Research Laboratories.

Suitable amino carboxylates to be used herein include ethylene diamine tetra acetates, diethylene triamine pentaacetates, diethylene triamine pentaacetate (DTPA), N-hydroxyethylethylenediamine triacetates, nitrilotri-acetates, ethylenediamine tetrapropionates, triethylenetetraamine-hexa-acetates, ethanol-diglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA).

Further carboxylate chelating agents to be used herein include salicylic acid, aspartic acid, glutamic acid, glycine, malonic acid or mixtures thereof.

Perfumes

The compositions according to the present invention may comprise, as an optional ingredient, a perfume ingredient preferably selected from the group consisting of: a cyclic terpene/sesquiterpene perfume, such as eucalyptol, cedrol, pinocarveolus, sesquiterpenic globulul alcohol; linalo; tetrahydrolinalo; verdox (cyclohexadiyl 2 tetryl butyl acetate); 6,3 hexanol; and citronellol and mixtures thereof.

Suitable perfumes for use herein include materials which provide an olfactory aesthetic benefit and/or cover any "chemical" odour that the product may have.

The compositions according to the present invention may comprise from 0.01% to 10%, preferably from 0.01% to 5%, more preferably from 0.01% to 1%, and most preferably from 0.1% to 0.1% by weight of the total composition of said perfume ingredient.

Dye

The liquid compositions according to the present invention may be coloured. Accordingly, they may comprise a dye. Suitable dyes for use herein are stable dyes. By "stable", it is meant herein a compound which is chemically and physically stable in the acidic environment of the compositions herein.

Preservative

The compositions according to the present invention may further comprise a preservative as an optional ingredient. Preservatives to be used herein include all those known to those skilled in the art ho hard-surface cleaner compositions. Preservatives are desired herein because they contribute to the stability of the compositions herein.

Suitable preservatives for use herein are diazolidinyl urea, triethyl citrate, propyl 4-hydroxybenzoate, sorbic acid, Na salt of p-hydroxybenzoate, gluteraldehyde, 1,2 benzisothiazolin-3-one (Proxel®) or a mixture thereof.

The Process of Treating a Hard-Surface:

The present invention encompasses a process of treating a hard surface with a liquid composition as described herein. In particular, the present invention relates to a method of removing limescale from a hard-surface comprising the step of applying the composition of the present invention onto the hard-surface, preferably onto a delicate hard surface.

By "treating" it is meant herein, cleaning, as the composition according to the present invention provides excellent cleaning performance on various stains.

By "limescale-containing stains" it is meant herein any pure limescale stains, i.e., any stains composed essentially of mineral deposits, as well as limescale-containing stains, i.e., stains which contain not only mineral deposits like calcium and/or magnesium carbonate but also soap scum (e.g., calcium stearate) and other grease (e.g. body grease).

By "hard surface", it is meant herein any kind of surface typically found in houses like kitchens, bathrooms, e.g., floors, walls, tiles, windows, cupboards, sinks, showers, shower plastified curtains, wash basins, WCs, dishes, fixtures and fittings and the like made of different materials like ceramic, vinyl, no-wax vinyl, linoleum, melamine, glass, Inox®, Formica®, any plastics, plastified wood, metal or any painted or varnished or sealed surface and the like. Hard-surfaces also include household appliances including, but not limited to refrigerators, freezers, washing machines, automatic dryers, ovens, microwave ovens, dishwashers and so on.

In a preferred embodiment according to the present invention, the hard surfaces to be cleaned in the process herein are delicate hard surfaces. Delicate hard surfaces describe all the surfaces which can be damage according to the use of acidic composition for example. Preferably, the hard surfaces to be cleaned in the process herein are enamel, stainless steel and/or aluminum hard surfaces, more preferably, enamel.

The present invention also encompasses a process of treating an enamel surface with a liquid composition according to the present invention. In a preferred embodiment said composition is contacted with said enamel surface. By "enamel surface" it is meant herein any kind of surface being made of or coated with enamel. By "enamel" it is meant titanium or zirconium white or colored enamel or titanium or zirconium white or colored powder enamel used as a coating for metal (e.g., steel,) surfaces preferably to prevent corrosion and aesthetic appearance of said surfaces.

The compositions of the present invention may be contacted to the hard-surface to be treated in its neat form or in its diluted form. Preferably, the composition is applied in its neat form.

By "in its neat form", it is to be understood that the liquid compositions are applied directly onto the surface to be treated without undergoing any dilution, i.e., the liquid compositions herein are applied onto the hard-surface as described herein.

By "diluted form", it is meant herein that said composition is diluted by the user with an appropriate solvent, typically with water. The composition is diluted prior use to a typical dilution level of 10 to 400 times its weight of water, preferably from 10 to 200 and more preferably from 10 to 100. Dilution may occur immediately prior to the application of the composition herein onto the hard surface to be cleaned, e.g., in an appropriate receptacle such as a bucket, wherein an effective amount of liquid composition herein is mixed with water.

In the process herein, said composition is applied onto said surface by conventional means known by the skilled person. Indeed, the composition may be applied by pouring or spraying said composition onto said surface. In a preferred embodiment, the composition is applied by spraying said composition onto said surface.

More preferably, said liquid composition is sprayed in its neat form onto said hard surface. In another preferred embodiment of the present invention said process of cleaning a hard surface includes the steps of applying, said liquid composition onto said hard surface, leaving said liquid composition to act onto said surface for a period of time to allow said composition to act, preferably without applying mechanical action, and optionally removing said liquid composition, preferably removing said liquid composition by rinsing said hard surface with water and/or wiping said hard surface with an appropriate instrument, e.g., a sponge, a paper or cloth towel and the like.

In another process of cleaning a hard surface according to the present invention, said composition is applied onto said surface in diluted form without rinsing the hard-surface after application in order to obtain good soil/stain removal performance.

By "rinsing", it is mean herein contacting the hard surface cleaned with the process according to the present invention with substantial quantities of appropriate solvent, typically water, directly after the step of applying the liquid composition herein onto said hard surface. By "substantial quantities", it is meant herein between 0.01 lt. and 1 lt. of water per $m^2$ of hard surface, more preferably between 0.1 lt. and 1 lt. of water per $m^2$ of hard surface Packaging Form of the Compositions The compositions herein may be packaged in a variety of suitable detergent packaging known to those skilled in the art. The liquid compositions are preferably packaged in conventional detergent plastic bottles.

In one embodiment the compositions herein may be packaged in manually or electrically operated spray dispensing containers, which are usually made of synthetic organic polymeric plastic materials. Accordingly, the present invention also encompasses liquid cleaning compositions of the invention packaged in a spray dispenser, preferably in a trigger spray dispenser or pump spray dispenser.

In one other embodiment the compositions herein may be packaged in a foam-from dispenser and/or in a foam-form pumping dispensers. The composition of the present invention can also be used on specific wipe containing said composition.

The invention is further illustrated by the following examples. The following examples are meant to exemplify compositions used in process according to the present invention but are not necessarily used to limit or otherwise define the scope of the present invention.

Example 1

Composition

These following compositions were made comprising the listed ingredients in the listed proportions (weight %). All the composition are adjust with water to 100%

Compositions I to VIII, of table 1, are compositions according to the present invention.

Compositions I to VIII exhibit excellent limescale removal performance and provide outstanding safety performance when used to treat delicate Hard surfaces.

Composition A to E, of table 2, are comparative examples.

TABLE 1

| Ingredients: | I | II | III | IV | V | VI | VII | VIII |
|---|---|---|---|---|---|---|---|---|
| Acetic acid | 8.0 | 10.0 | 13.0 | — | — | — | — | 3.0 |
| Propionic acid | — | — | — | 8.0 | 10.0 | 13.0 | — | — |
| Butyric acid | — | — | — | — | — | — | 10.0 | — |
| Dobanol ® 91-8 | 2.2 | 1.5 | 0.45 | 2.2 | 1.5 | 0.45 | 1.5 | 2.2 |
| Isalchem ® 123 AS | — | 2.0 | — | — | 2.0 | — | 1.0 | — |
| Kelzan T ® | 0.4 | 0.50 | 0.1 | 0.4 | 0.50 | 0.1 | 0.4 | 0.4 |
| PVP | 0.25 | 0.05 | — | 0.25 | 0.05 | — | 0.25 | 0.25 |
| n-BPP | 1.0 | 2.0 | — | 1.0 | 2.0 | — | 1.0 | 1.0 |
| KOH | 0.7 | 1.0 | — | 0.5 | 0.7 | — | 0.5 | 0.3 |
| NaOH | — | — | 0.4 | — | — | 0.2 | — | — |
| BHT | 0.03 | 0.05 | — | 0.03 | 0.05 | — | 0.03 | 0.03 |
| perfume | 0.05 | 0.5 | 0.05 | 0.5 | 0.05 | 0.5 | 0.3 | 0.05 |
| dyes | 0.01 | 0.010 | 0.01 | 0.010 | 0.01 | 0.010 | 0.01 | 0.01 |
| pH | 3.6 | 3.6 | 3.6 | 3.6 | 3.6 | 3.6 | 3.6 | 3.6 |

TABLE 2

| Ingredients: | A | A' | B | B' | C | C' | D | D' | E | E' |
|---|---|---|---|---|---|---|---|---|---|---|
| Acetic acid | 8.0 | 8.0 | — | — | — | — | — | — | — | — |
| Propionic acid | — | — | 8.0 | 8.0 | — | — | — | — | — | — |
| Phosphoric acid | — | — | — | — | 8.0 | 8.0 | — | — | — | — |
| Lactic acid | — | — | — | — | — | — | 8.0 | 8.0 | — | — |
| Citric acid | — | — | — | — | — | — | — | — | 8.0 | 8.0 |
| Dobanol ® 91-8 | 2.2 | 2.2 | 2.2 | 2.2 | 2.2 | 2.2 | 2.2 | 2.2 | 2.2 | 2.2 |
| KOH | 0.7 | — | 0.5 | — | 0.7 | — | 2.0 | — | 2.3 | — |
| pH | 3.6 | 2.2 | 3.6 | 2.4 | 3.6 | 1.1 | 3.6 | 1.9 | 3.6 | 1.7 |

Dobanol® 91-8 is a $C_9$-$C_{11}$ ethoxylated alcohol commercially available from Shell.

Isalchem123AS® is a branched alkyl-sulphates commercially available from Enichem.

Kelzan T® is a Xanthan gum supplied by Kelco.

PVP is Polyvinylpyrrolidon polymer.

n-BPP is butoxy propoxy propanol commercially available from Dow Chemical.

BHT is Butylated Hydroxy Toluene.

Example 2

Hard Surface Damage Test Method and Cleaning Performance Test Method

The degree of hard surface damage and the cleaning performance of compositions A to E, having different pH, are evaluated according to the following tests method.

A. Hard Surface Damage Test Method

A few drops of the composition according to the present invention, containing different acid system, at different pH, are placed on delicate hard surfaces (e.g., on Blue enamel tile and on Matt/rough Stainless Steel). Afterwards, the surface is covered with a watch glass. After 16 h exposure, the watch glass is removed, the Hard surface is rinsed with water (either demineralised or tap) and then wiped dry.

Test results are reported based on visual examination (visual grading) on a scale 0 to 6 (with 0=no damage; 1=possibly visible damage: 2=minor visible damage; 3=visible damage; 4=strong visible damage; 5=very strong visible damage; 6=severe damage).

B. Limescale Removal Performance Test Method:

The Limescale removal performance may be evaluated by the following test method: hard surfaces (tiles of enamel and of Matt/rough Stainless Steel) are prepared by applying to them a representative limescale stain followed by ageing. The test compositions and a reference composition (standard and highly performing limescale removal composition: Viakal®) are applied to a wet sponge, and used to clean the tiles with a Sheen scrub tester. The number of strokes required to clean to 100% clean is recorded. A minimum of 6 replicates can be taken with each result being generated in duplicate against the reference on each tile. Results are reported as cleaning index versus standard and performing enamel removal Spray acid system.

TABLE 3

| Acid | | | Surface Damage Visual grading | | Limescale |
|---|---|---|---|---|---|
| (8% weight) | pKa | pH | Enamel | Steel | Removal Index |
| Phosphoric | 2.12 | 1.1 | 5.5 | 4 | 59 |
| | | 3.6 | 0.5 | 4 | <<<35 no soil removal* |
| Lactic | 3.8 | 1.9 | 6 | 2.5 | 94 |
| | | 3.6 | 5 | 2 | 38 |
| Acetic | 4.75 | 2.2 | 3 | 2 | 115 |
| | | 3.6 | 0 | 0.5 | 92 |
| Propionic | 4.87 | 2.4 | 4.5 | 1.5 | 81 |
| | | 3.6 | 0 | 0.5 | 80 |
| Citric | 3.1 | 1.7 | 6 | 4.5 | 76 |
| | | 3.6 | 3 | 2.5 | 70 |

*= After 200 strokes

The table 3 clearly show that significant results on surface damage safety (i.e. having a visual grading less than 2) in the same time with good performance on limescale removal (i.e. having a Limescale Removal Index of more than 70) are obtained when the composition contains a weak acid which has a pKa comprised between 4 and 6 and when the pH of the composition is between 3 and 4.

Thus, these data clearly show that the composition according to the present invention provide in the same time surface damage safety and good limescale removal performance.

Example 3

Greasy Soap Scum Cleaning Performance Test

The Greasy soap scum cleaning performance of the compositions of the present invention are evaluated according to the following tests method:

Greasy Soap Scum Cleaning Performance Test Method:

Enamel white tiles (typically 25 cm×7 cm) are covered with typical greasy soap scum soils mainly based on calcium stearate and artificial body soils commercially available (e.g. 0.3 grams with a sprayer). The soiled tiles are then dried in an oven at a temperature of 140° C. for 10-45 minutes, preferably 40 and then aged between 2 and 12 hours at room temperature (around 20° C.-25° C.) on a controlled environment humidity (60-85%, preferably 75). Then the soiled tiles are cleaned using 5 ml of the composition of the present invention poured directly on a sponge (Spontex®) (with or without soaking, preferably without soaking). The ability of the composition to remove greasy soap scum is measured through the number of stroke cycles needed to perfectly clean the surface. The lower the number of stroke cycles, the higher the greasy soap scum cleaning ability of the composition.

The result of the Greasy soap scum cleaning performance are expressed by reference to a standard global reference (100) reflecting the standard cleaning effect of common hard surface compositions. The test is performed using a product available on the market as reference.

The cleaning index has been evaluated, according to the above method, using the composition I of the table 1 above with the presence of surfactants (2.2% of Dobanol® 91-8) and without the presence surfactants. All the results are statistically significant (with Significance at a 5% risk).

| Composition 8% acetic Acid pH = 3.6 | Composition I with 2.2% Surfactants | Composition I Nil surfactant |
|---|---|---|
| Cleaning Index | 124 | <<<32 |

These data clearly show the relevance of the presence of surfactants in the composition according to the present invention.

Thus, these data clearly show that the composition according to the present invention provide excellent Greasy soap scum cleaning performances.

Therefore, these data demonstrate that the composition according to the present invention provide excellent Greasy soap scum cleaning performances in the same time with surface damage safety and good limescale removal performance.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid hard surface cleaning composition, having a pH of 3 to 4, obtained upon the mixing of:

a. 0.1% to 25% of acetic acid agent, b. a source of alkalinity; and c. a surfactant system, wherein said acetic acid is the only acid included in said composition and said composition does not include bleach.

2. The liquid hard surface cleaning composition according to claim 1 wherein the source of alkalinity is selected from the group consisting of caustic alkalis, alkali metal oxides, alkali metal carbonates or bicarbonates, ammonia, ammonium carbonate, hydrogen carbonate with the exclusion of magnesium carbonate and calcium carbonate.

3. The liquid hard surface cleaning composition according to claim 1 wherein the source of alkalinity is sodium hydroxide or potassium hydroxide.

4. The liquid hard surface cleaning composition according to claim 1 wherein the source of alkalinity is not created during the use of the composition, but added to the composition before the use.

5. The liquid hard surface cleaning composition according to claim 1 wherein the source of alkalinity is present in an amount of from 0.001% to 20% by weight of the composition.

6. The liquid hard surface cleaning composition according to claim 1 wherein the composition comprises up to 30% by weight of the total composition of a surfactant system.

7. The liquid hard surface cleaning composition according to claim 1 wherein the composition further comprises one or more ingredients selected from the group consisting of chelating agent, homo or copolymers of vinylpyrrolidone, polysaccharide polymers, watersoluble or water-dispersible copolymer, radical scavengers, perfumes, dyes and mixtures thereof.

8. A process of cleaning hard-surface comprising the step of applying a composition according to claim 1 onto said hard-surface, leaving said composition on said hard-surface to act, optionally wiping said hard-surface, and then rinsing said hard-surface.

9. A process according to claim 8 wherein said surface is a delicate hard surface.

10. A method of removing limescale and/or soap scum on hard surface while maintaining surface safety, comprising the step of providing the composition according to claim 1 to said hard surface.

11. The liquid hard surface cleaning composition according to claim 1 wherein the source of alkalinity is selected from the group consisting of alkali metal carbonates or bicarbonates, ammonia, ammonium carbonate, and hydrogen carbonate, with the exclusion of magnesium carbonate and calcium carbonate.

12. The liquid hard surface cleaning composition according to claim 1 wherein the source of alkalinity is present in an amount ranging from 0.004% to 1.5% by weight of the composition.

13. The liquid hard surface cleaning composition according to claim 1, wherein the single acid agent comprises 8% by weight of the composition.

14. The liquid hard surface cleaning composition according to claim 1 wherein the surfactant system comprises a cationic surfactant.

15. A liquid hard surface cleaning composition, having a pH of 3 to 4, obtained upon the mixing of:

a. acetic acid;

b. a source of alkalinity present in an amount of from 0.004% to 1.5% by weight of the composition; and c. a surfactant system, wherein the surfactant system comprises a cationic surfactant, wherein said acetic acid is the only acid included in said composition and said composition does not include bleach.

16. The liquid hard surface cleaning composition according to claim 15, wherein the acetic acid agent comprises 8% by weight of the composition.

* * * * *